United States Patent [19]

Paton et al.

[11] 4,154,973

[45] May 15, 1979

[54] INGOT ELECTROSLAG REMELTING APPARATUS

[75] Inventors: Boris E. Paton; Boris I. Medovar; Alexandr P. Beloglazov; Valery A. Prikhodko; Georgy A. Boiko; Ilya I. Kumysh, all of Kiev; Valentin S. Zameshaev, Moscow; Jury A. Nadtochy; Alexandr I. Zvyagintsev, both of Tolyatti Kuibyshevskoi oblasti, all of U.S.S.R.

[73] Assignee: Institut Elektrosvarki Imeni E.O. Patona Akademii Nauk Ukrainskoi SSR, Kiev, U.S.S.R.

[21] Appl. No.: 854,756

[22] Filed: Nov. 25, 1977

[51] Int. Cl.[2] ..... H05B 7/102

[52] U.S. Cl. ..... 13/9 ES; 13/16

[58] Field of Search ..... 13/14–17, 13/9 ES; 214/1 BD, 130 R, 147 G

[56] References Cited

U.S. PATENT DOCUMENTS

| | | | |
|---|---|---|---|
| 3,660,584 | 5/1972 | Holzgruber et al. | 13/9 ES X |
| 3,689,680 | 9/1972 | Reimpel et al. | 13/9 ES |

*Primary Examiner*—R. N. Envall, Jr.
*Attorney, Agent, or Firm*—J. Harold Nissen

[57] ABSTRACT

An ingot electroslag remelting apparatus is provided with two electrode holders for feeding consumable electrodes into the melting space of a mould. The electrode holders are secured to ends of booms rotatable in a vertical plane. The booms are mounted on carriages slidable in vertical guides.

The proposed invention reduces the time necessary to replace a melted consumable electrode by a fresh one in the melting space of the mould.

10 Claims, 8 Drawing Figures

INGOT ELECTROSLAG REMELTING APPARATUS

1. BACKGROUND OF THE INVENTION a. Field of the Invention

The present invention relates to electrometallurgy, and, in particular, to ingot electroslag remelting apparatus.

b. Description of the Prior Art

The present invention may find a most effective application in the manufacture of relatively large ingots requiring the remelting of several consumable electrodes fed successively into the melting space.

In electroslag remelting of such ingots a critical problem is to replace in the course of remelting a melted consumable electrode by a fresh one in a manner to prevent the liquid metal inside the mould from solidifying during the time the consumable electrode is out of the melting space.

In apparatus for electroslag remelting of ingots of relatively large diameters, the continuity of melting is ensured by auxiliary electrodes located alongside the main one over the surface of the slag bath in the mould. When the melted main electrode is being removed, current is supplied through the auxiliary electrodes thereby maintaining required thermal conditions during the replacement of the main electrode.

In apparatus for manufacturing ingots whose diameters make it impossible to place more than one electrode over the mould, use is made of at least two mobile electrode holders to prepare in advance a fresh electrode and to effect the replacement as quickly as possible.

There is known in the art an apparatus for electroslag remelting of ingots with alternate feeding of consumable electrodes into the melting space, vertical guides in the form of columns provided on both sides of the mould for the travel on each of them of a carriage with an electrode holder electrically connected to a power source (cf. Austrian Pat. No. 286514, Cl.31b 2/03, 1973). Each carriage is mounted on a corresponding column and rotatable about the column axis thereby ensuring the motion of the electrode holder along a circular arc in a horizontal plane.

Each carriage is geared to two independent drive means: a vertical travel drive means and a rotation drive means.

To replace a melted consumable electrode by a fresh one, the vertical travel drive means is actuated to lift the carriage with the electrode holder and the melted consumable electrode above the top edge of mould walls, then the rotation drive means is actuated to move the electrode holder out of the mould zone. Another carriage with the electrode holder carrying a fresh consumable electrode is first rotated horizontally with the aid of a drive means at a height allowing the consumable electrode to clear the top edge of the mould walls, then lowered to a required level by energizing the vertical travel drive means.

Thus, the displacement of each electrode holder, when replacing a melted consumable electrode by a fresh one, involves two kinds of motion, thereby requiring a sequential operation of the corresponding drive means and relatively much time. Moreover, it is impossible to move the replacing consumable electrode into the mould zone until the consumable electrode being replaced is lifted above the top edge of the mould walls and rotated partially in a horizontal plane. As the consumable electrode is out of the melting space for a prolonged time, this giving rise to such defects as peeling, surface corrugations and the like.

SUMMARY OF THE INVENTION

It is an object of the invention to provide an ingot electroslag remelting apparatus wherein the time required to replace a melted consumable electrode in the mould melting space is reduced to a value of no effect upon the structure of the solidifying ingot.

Another object of the invention is to provide an ingot electroslag remelting apparatus which will make it possible to remove a melted consumable electrode and introduce in its place a fresh one in a single motion of each of the two electrode holders.

A further object of the invention is to provide an ingot electroslag remelting apparatus which will make it possible to bring the electrode holders very close together prior to the replacement of the melted consumable electrode by a fresh one in the mould melting space.

A still another object of the invention is to provide an ingot electroslag remelting apparatus in which a consumable electrode freshly introduced into the mould melting space is connected automatically to a power source.

Yet another object of the invention is to provide an ingot electroslag remelting apparatus which would ensure a strictly plane-parallel motion of the electrode holder as a consumable electrode is being introduced into the mould melting space.

These and other objects and features of the invention are attained in an ingot electroslag remelting apparatus with alternate feeding of consumable electrodes into the melting space and with vertical guides on both sides of the mould for receiving on each of them a travelling carriage with an electrode holder electrically connected to a power source and movable along a circular arc, according to the invention, the electrode holder is connected to the carriage by means of a boom, one end thereof being attached to the carriage in a manner to allow the other end of the boom with the electrode holder secured thereto to describe a vertical circular arc.

A vertical rotation of the electrode holder provided by the aforedescribed apparatus design makes it possible to remove a melted consumable electrode in a single motion of the boom without using the vertical displacement of the carriage to lift the melted consumable electrode above the top edge of the mould walls. Similarly, a fresh consumable electrode can be introduced into the mould melting space by means of a single rotation of the other boom, using the vertical displacement of the carriage for a pre- adjustment of the consumable electrode to a required height. The electrode holder carrying a fresh consumable electrode can thus be brought alongside the consumable electrode butt to be replaced thereby minimizing the angle of rotation in opposite directions of the booms with the electrode holders during the replacement of the consumable electrodes. This reduces the time during which the consumable electrode is out of the mould melting space and eliminates the possibility of an undesirable effect due to a break in the melting process.

The boom may be connected to the carriage by means of a shaft mounted for rotation about its own axis in the carriage orifice whose axis is horizontal, the shaft being rigidly connected to the boom by its end which projects beyond the carriage.

To effect the rotation of the boom, it is expedient that the shaft end, opposite to that which carries the boom, be geared to the boom rotation drive means mounted on the carriage.

As regards the possibility of bringing the electrode holders as close together as is practically possible prior to the replacement of the consumable electrode butt in the melting space of the mould, it is advantageous that the electrode holders be connected to the booms by means of hinged joints, the electrode holders then remaining vertical as the booms are rotated.

It is of practical importance that the hinged joint be in the form of a pivot mounted in the boom orifice for rotation about its own axis and rigidly attached to the electrode holder by its end projecting beyond the boom.

To remove a consumable electrode butt out of the mould, it is necessary to displace it vertically until its lower edge clears the top edge of the mould walls. To this end, the boom rotation axes should be disposed so as to have the mould axis of symmetry pass substantially along a tangent to both arcs representing the paths of motion of the hinged joint axes. This also ensures the best, from the viewpoint of the remelting process, location of the consumable electrode along the mould centre line.

For an automatic connection of the consumable electrode to a power source the moment it is introduced into the melting space, it is advantageous, with the electrode holder being in a position wherein the consumable electrode clamped in the electrode holder is located substantially along the mould axis of symmetry, that the electrode holder be connected to a power source through a contact formed, on the one hand, by a section of the horizontal surface of the electrode holder, and, on the other hand, by a current-conducting plate arranged on the horizontal platform of the carriage and offset with respect to the shaft toward the mould to ensure contact with said section of the electrode holder surface.

To maintain the boom in a position facilitating the replacement of the consumable electrode in the electrode holder, it is good practice to mount a supporting platform on the carriage underneath the shaft on the side opposite to the mould.

The consumable electrode is prevented from swinging with respect to a vertical axis on being introduced into the melting space of the mould by the provision of a shaped recess formed on the carriage on the side thereof facing the boom, and of a pin affixed on the corresponding electrode holder, the surface of the shaped recess being required to ensure contact with the pin along a circular are described about the shaft axis at the end of travel of the boom in the direction of the mould.

The pin, in particular, may be connected to the electrode holder through a lever rigidly connected to the end of the hinged joint pivot projecting beyond the boom on the side opposite the electrode holder.

BRIEF DESCRIPTION OF THE DRAWINGS

The invention will now be explained in greater detail with reference to embodiments thereof which are represented in the accompanying drawings, wherein.

DESCRIPTION OF THE PREFERRED EMBODIMENTS

Figure 1:
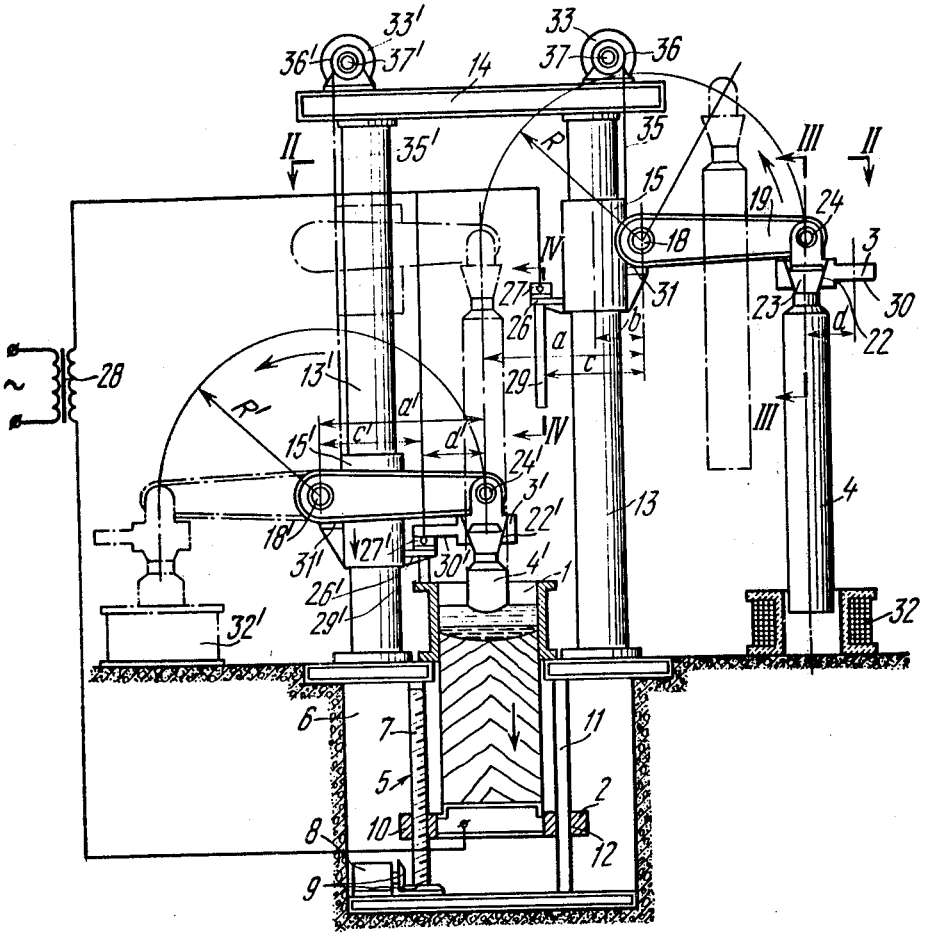
FIG. 1 is a schematic general view of an apparatus for electroslag remelting of ingots in accordance with the invention.

An apparatus for electroslag remelting of ingots comprises an open-ended mould 1 mounted on a movable stool 2 and two electrode holders 3 and 3' for alternate feeding of consumable electrodes 4 and 4' into the melting space formed by walls of the mould 1. An ingot withdrawal means 5 comprises a screw 7 geared to a drive means 8 for moving the stool 2 with the aid of a bevel gearing 9. The stool 2 is in threaded engagement with the vertical screw 7 effected through a threaded orifice 10. A fixed upright 11, loosely fitted in an orifice 12 of the stool 2 and serving as a guide for the vertical motion of the stool 2, is mounted in a pit 7 of the foundation symmetrically with respect to the vertical screw 7 as regards the axis of symmetry of the mould 1. Vertical guides in the form of columns 13 and 13', connected at the top by a crosspiece 14, are mounted fixedly on both sides of the mould 1.

Since the above-ground part of the proposed apparatus consists of two identical halves, the description of the right-hand half holds true for the elements of the left-hand half, the elements thereof are designated by the same reference numerals, but provided for the sake of distinction with a prime " ' ".

According to the invention, there is mounted for longitudinal movement on the column 13 a carriage 15 with a supporting projection 16 thereof (FIG. 2) being formed with an orifice such as shown at 17, whose axis is horizontal. Mounted for rotation in the orifice 17 is a shaft 18 (see FIGS. 1, 2) rigidly attached to a boom 19 carrying at its end the electrode holder 3. The electrode holder 3 is formed with mating vertical and horizontal flanges 20 and 21 shown in FIG. 3). The horizontal flange 21 is provided with a wedge-shaped slot such as shown at 22 in FIG. 1, conforming in shape and size to a head 23 which is a standard equipment component fitted on each of the consumable electrodes 4.

The electrode holder 3 is connected to the end of the boom 19 by means of a hinged joint 24. The pivot of the hinged joint 24 (FIG. 3) is rigidly attached to the vertical flange 20 of the electrode holder 3 and fitted loosely in an orifice 25 of the boom 19.

The distance "a" (FIG. 1) between the axis of symmetry of the mould 1 and the horizontal axis of rotation of the boom 19 (coinciding with the geometric axis of the shaft 18) is made equal to radius R of rotation of the boom 19 corresponding to the distance between the shaft 18 and the axis of the hinged joint 24 in order to locate the axis of symmetry of the mould 1 tangentially to an arc which is the path of motion of the axis of the hinged joint 24. This arrangement is optimum as regards the replacement of one consumable electrode 4 by another when the consumable electrode 4 is to be carried over the walls of the mould 1.

Figure 3:
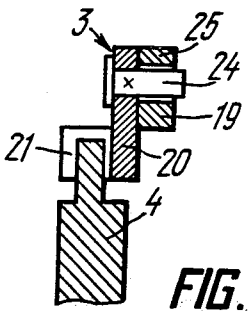
FIG. 3 is a cross-section taken along line III—III of FIG. 1.

The carriage 15 is provided on the side thereof facing the mould 1 with a horizontal platform 26 mounting a current-carrying plate 27 (FIGS. 1, 3). The current-carrying plates 27 and 27' (FIG. 1) of both the carriages 15 and 15' are connected in parallel to a common power source 28 by means of flexible current leads 29 and 29'. The axis of symmetry of the current-supply plate 27 is offset with respect to the axis of the shaft 18 toward the mould 1 by a value of $c=R-d$ (1), where d is the distance from the axis of the hinged joint 24 (FIG. 1) to the axis of symmetry of a section 30 of the horizontal surface of the electrode holder 3 measured along the boom 19. This ensures the contact between the current-carrying plate 27 and the section 30 of the electrode holder 3 horizontal surface when the boom 19 is in a position when the axis of the wedge slot 22, coinciding with the axis of the consumable electrode 4, passes through the centre line of the mould 1.

To maintain the boom 19 in a position facilitating the replacement of the consumable electrode 4, the carriage 15 is provided with a supporting platform 31 underneath the shaft 18, with at least a portion thereof being offset with respect to the axis of the shaft 18 in a direction opposite the mould 1. FIG. 1 shows the boom 19 in a position when the consumable electrode 4 is being replaced in the electrode holder 3. Resting upon the supporting platform 31 the boom 19 occupies a horizontal position which is preferable in this case, although, in principle, the boom 19 may be fixed in any other position which makes it possible to move the consumable electrode 4 beyond the melting space.

To effect preheating of the consumable electrode 4 positioned for the replacement, there is provided an inductor 32 whose axis coincides with that of the wedge slot 22 in the electrode holder 3 when the boom 19 rests upon the supporting platform 31 of the carriage 15.

Figure 2:
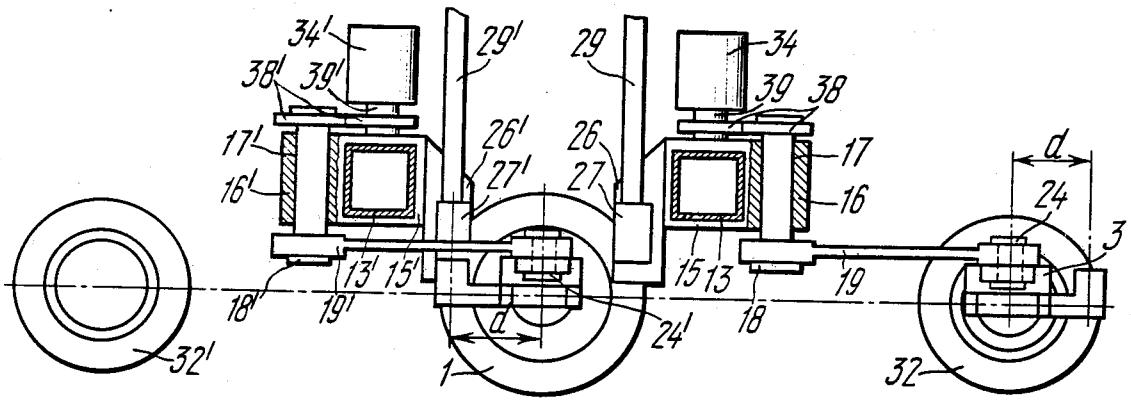
FIG. 2 is a cross-section taken along line II—II of FIG. 1.
Figure 4:
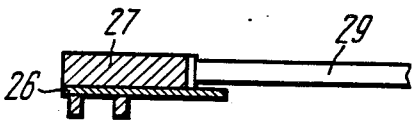
FIG. 4 is a cross section taken along line IV—IV of FIG. 1.

The electrode holder 3 is actuated by two independent drive means, of which the vertical displacement drive means 33 is arranged or located on a crosspiece 14, and a rotation drive means 34, of the boom 19 (FIG. 2), on the carriage 15. The drive means 33 (FIG. 1) comprises a chain 35 rigidly connected to the carriage 15 and geared to a sprocket 36 mounted on an output shaft 37. The boom 19 rotation drive means 34 comprises a gearing 38 (FIG. 2). One of the gears of the gearing 38 is mounted on an output shaft 39 of the drive means 34, and the other, horizontally on the shaft 18.

Figure 5:
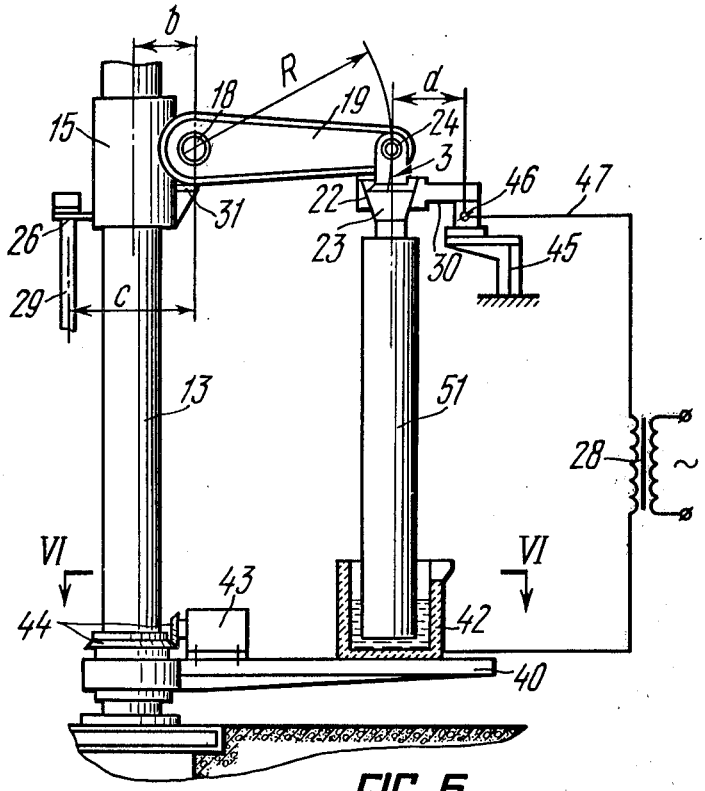
FIG. 5 is a partial view of an embodiment of an apparatus for electroslag remelting of ingots in accordance with the invention, showing a platform with crucible-ladle for melting flux.
Figure 6:
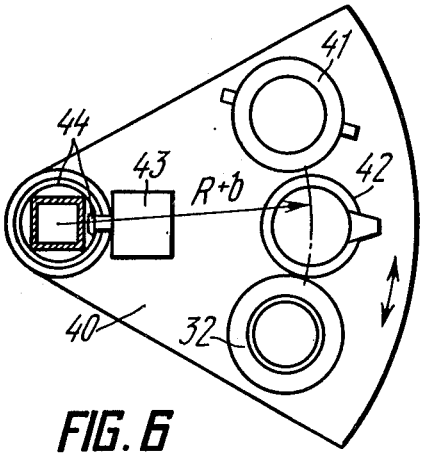
FIG. 6 is a cross-section taken along line VI—VI of FIG. 5.

A feature of one embodiment of the apparatus according to the invention, whose partial view is shown in FIGS. 5 and 6, is the provision of a platform 40 shaped as a horizontal sector arranged for rotation on the column 13 about its axis and carrying the inductor 32 (FIG. 6), an additional mould 41 and a crucible-ladle 42 (FIGS. 5 and 6) placed at a distance $R+b$ from the column 13 axis, where b is the distance between the axis of the column 13 and rotation axis of the boom 19. The platform 40 carries a rotation drive means 43 formed with a bevel gearing 44.

To supply current to the electrode holder 3 when melting an ingot in the additional mould 41 and when melting a flux in the crucible-ladle 42 there is, provided on a fixed support 45 (FIG. 5) an auxiliary spring-loaded current-carrying plate 46 with a conductor 47 electrically connected to the power source 28. The axis of symmetry of the auxiliary current-carrying plate 46 is located at a distance $R+d$ from rotation axis of the boom 19, whereas its surface, contacting the section 30 of the horizontal surface of the electrode holder 3, is placed at such a height as to ensure the supply of current the moment the corresponding consumable electrode, mounted in the electrode holder 3, immerses into the additional mould 41 (FIG. 6) or the crucible-ladle 42 (FIGS. 5 and 6). Although the drawings of FIGS. 5 and 6 show one platform 40 only, it should be understood that the apparatus has two such platforms 40 and 40' with corresponding equipment mounted on the both columns 13 and 13'.

Figure 7:
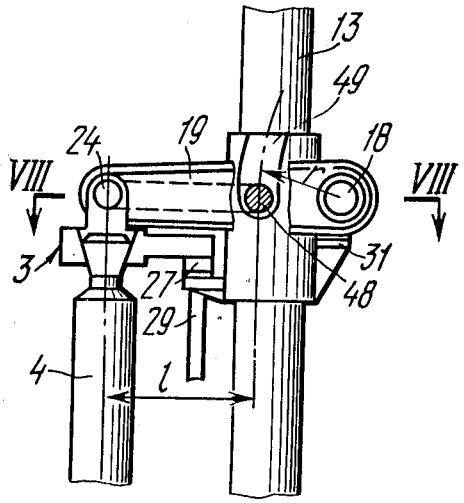
FIG. 7 is a view of an embodiment of the apparatus carriage formed with a shaped recess in accordance with the invention.
Figure 8:
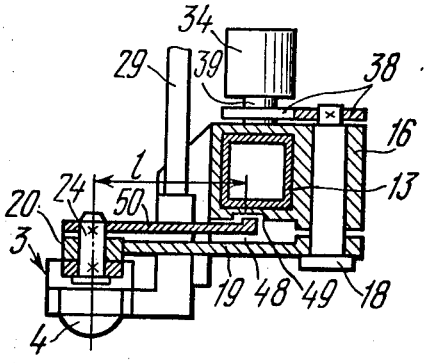
FIG. 8 is a cross-section taken along line VIII—VIII of FIG. 7.

FIGS. 7 and 8 show an embodiment of the carriage 15 of the apparatus for the consumable electrode 4 of a diameter close in size to that of the mould 1, this entailing a risk of having the walls of the latter damaged as a result of the electrode 4 swinging movement effected by the boom 19. In said embodiment, the electrode holder 3 has a pin 48, and the carriage 15, a shaped recess 49 provided in the wall facing the boom 19. The recess is shaped according to a circular arc described about the axis of the shaft 18 at a radius r corresponding to the distance between said axis and that of the pin 48.

In the given embodiment, the pin 48 is a cylindrical boss of a lever 50 arranged parallelly to the boom 19 and rigidly connected to the pivot of the hinged joint 24 which, in turn, is secured rigidly to the vertical flange 20 of the electrode holder 3. Assuming i to be the distance between the axis of the pin 48 and that of the hinged joint 24 as measured along the lever 50, then the radius of the shaped recess 49 can be determined as the difference $r=R-1$ (2). Although the drawings of FIGS. 7 and 8 show one shaped recess 49 and one pin 48 corresponding to it, it should be understood that the apparatus is formed with two shaped recesses 49 and 49' and correspondingly two pins 48 and 48'.

The apparatus of the invention operates as follows.

By actuating the carriage 15' on the column 13' with the aid of the vertical displacement drive means 33', the consumable electrode 4' is placed inside the mould 1 to a required height with respect to the stool 2, initially found in its topmost position, thereby closing from underneath the cavity of the mould 1. Next, molten slag is poured into said cavity of the mould 1, to thereby initiate the remelting process.

As the consumable electrode melts, the vertical displacement drive 33' lowers the carriage 15 along the column 13' at a corresponding rate, and the ingot is thus pulled downwards with the aid of the stool 2 actuated by a screw 7 of the ingot withdrawal mechanism 5. During this time the other boom 19 rests upon the supporting platform 31 of the carriage 15. The consumable electrode 4 is carried to the electrode holder 3 by means of a crane (not shown on the drawings) and engaged by its permanent standard equipment head 23 into the wedge slot 22 in a manner that the consumable electrode 4 hangs by resting against the bevelled faces of the head 23. The carriage 15 is moved vertically along the column 13 to engage the end of the consumable electrode 4 inside the inductor 32 to preheat the consumable electrode 3, thereby minimizing the cooling of the molten slag when the consumable electrode is introduced into the melting space of the mould 1. Directly before the remelting of the consumable electrode 4' is completed, the carriage 15 is lowered by means of the vertical displacement drive 33 in a manner to place the bottom edge of the consumable electrode 4 level with the slag bath, and using the boom 19 rotation drive means 34 (FIG. 2), the boom 19 (FIG. 1) is pre-rotated in the direction of the mould 1 to place the consumable electrode 4 as close as is practically possible to its axis of symmetry without hindering the removal of the butt of the consumable electrode 4' from the mould 1. Thereafter, the butt of the consumable electrode 4' is removed, and a fresh consumable electrode 4 is introduced in its place by rotating both booms 19 and 19' in opposite directions. In the process, the moment the section 30 of the horizontal surface of the consumable electrode holder 3 comes into contact with the current-carrying plate 27 of the carriage 15, the consumable electrode 4 is connected to the power source 28, and the interrupted melting resumes.

After the boom 19' is backed away as far as it will go against the supporting platform 31', which corresponds to a 180° rotation of the boom 19' in the considered embodiment of the invention, the carriage 15' is moved upwards to initial position, and the butt of the consumable electrode 4' is removed from the electrode holder 3' with the aid of a crane, and a fresh consumable electrode 4' is placed in its stead, the fresh consumable electrode 4' being then prepared, while the consumable electrode 4 is being remelted in the mould 1, for introduction into the melting space in the manner similar to that described above.

In as much as it may take an appreciable amount of time (one hour or more) for remelting one consumable electrode 4 or 4' in the mould 1 where relatively large ingots are produced, a provision has been made in the preferred embodiment of the apparatus according to the invention, shown in part in FIGS. 5 and 6, to simultaneously melt a smaller ingot in the auxiliary mould 41 or 41'. To this end, an additional consumable electrode, smaller than the consumable electrode 4 intended for remelting in the mould 1 is placed into the now free electrode holder, for instance, into that shown at 3. The centre line of the additional mould 41 (not shown) is aligned with the axis of said consumable electrode with the aid of the drive means 43 which rotates the platform 40 about the axis of the column 13. Next, the additional consumable electrode is placed at a required height in the auxiliary mould 41 by moving the carriage 15 along the column 13. The section 30 of the horizontal surface of the electrode holder 3 bears up against the current-carrying platform 46 (FIG. 5) and connects the additional consumable electrode to the power source 5. Molten slag is then poured into the additional mould 41, and remelting is conducted by lowering the carriage 15 as the additional consumable electrode is remelted. The sizes of the auxiliary mould 41 and of the additional consumable electrode should be chosen in a manner to obtain a finished ingot in the auxiliary mould 41 and to prepare a fresh consumable electrode 4 for introduction into the mould 1 during the time required to remelt the consumable electrode 4' in the mould 1. After the remelting of the ingot in the auxiliary mould 41 is completed, the electrode holder 3 is lifted by moving the carriage 15 accordingly, and the butt of the additional consumable electrode is replaced by a fresh consumable electrode 4. The platform 40 is then rotated to align the axis of the consumable electrode 40 with that of the inductor 32, then the carriage 15 is moved along the column 13 to lower the end of the consumable electrode 4 into the cavity of the inductor 32. The butt of the consumable electrode 4' is replaced in the mould 1 by a fresh consumable electrode 4 in the manner similar to that described above.

When the remelting of an ingot in the mould 1 is nearing completion, the free electrode holder, for example that shown at 3 is fitted with a nonconsumable electrode 51 and used to melt flux in the crucible-ladle 42 instead of manufacturing a smaller ingot in the auxiliary mould 41 or 41'. To this end, the platform 40 is rotated to align the axes of the crucible-ladle 42 and of the nonconsumable electrode 51 and the carriage 15 is moved to lower the nonconsumable electrode into the crucible-ladle 42 to a required height. The section 30 of the horizontal surface of the electrode holder 3 then comes into contact with the additional spring-loaded current-carrying plate 46, thereby automatically connecting the nonconsumable electrode 51 to the power source 28. Flux is charged into the crucible-ladle 42 and melted. When melting is completed, the nonconsumable electrode 51 is removed from the crucible-ladle 42, and the latter is backed out by rotating the platform 40.

Once melting is completed in the mould 1, the electrode holder 3', carrying the butt of the consumable electrode 4', is removed from the mould 1 by rotating the boom 19' until it thrusts up against the supporting platform 31'. At the same time, the finished ingot is removed from the mould 1 by means of the ingot withdrawal means 5, the stool 2 then being returned to starting position, whereas a fresh consumable electrode 4 is introduced into the mould 1 (both operations may be effected simultaneously). Molten slag from the crucible-ladle 42 is poured inside the mould 1, and the above cycle is then repeated.

Thus, the time necessary to effect the majority of the prolonged preparatory operations in the given embodiment of the apparatus coincides with that required to melt an ingot in the mould 1, thereby enhancing the ingot manufacturing efficiency.

When the carriages 15 and 15' are provided with the shaped recesses 49 and 49' respectively, the pin, for instance that shown at 48 (FIGS. 7 and 8) enters the shaped recess 49 at the final stage of rotation of the boom 19, the shaped recess 49 being enlarged at the top to facilitate the engagement of the pin 48. As the boom 19 rotates further, the pin 48 slides along the shaped recess 49, thereby preventing the swinging of the electrode holder 3 about the axis of the hinged joint 24. Thus, the consumable electrode 4 is introduced inside the mould 1 in a plane-parallel motion and remains vertical. This is of particular importance where the difference between the cross sectional dimensions of the mould 1 and of the consumable electrode 4 are relatively small, since the swinging of the consumable electrode 4 may cause damage to the walls of the mould 1.

The herein described apparatus makes possible a rapid replacement of the consumable electrode by a fresh one inside the mould melting space and thereby improves the quality of resultant ingots.

It is to be understood that the form of our invention, herewith shown and described, is to be taken as a preferred embodiment, and that various changes in the shape, size, and arrangement of parts may be resorted to, without departing from the spirit of our invention, or the scope of the claims below.

What we claim is:

1. An apparatus for electroslag remelting of ingots with alternate feeding of consumable electrodes into a melting space comprising:

at least one mould;

two vertical guides arranged on both sides of the mould;

two carriages each being mounted on the corresponding one of said vertical guides and slidable along said vertical guide;

two booms, one end of each said booms being connected to the corresponding one of said carriages; two electrode holders being secured on the end of the corresponding boom of the two said booms;

a power source electrically connected to said electrode holders;

first drive means for each said carriages for lifting thereof with a melting consumable electrode out of said at least one mould and for lowering thereof with a consumable electrode into said mould; and, second drive means for each said carriages to move said one end of each said booms along a circular arc from a first position away from said mould to a second position in alignment with said mould prior to the lowering of the consumable electrode into said mould by said first drive means and to move said one end of each said booms along a circular arc from the second position after said first drive means has withdrawn the melted consumable electrode to the first position.

2. An apparatus as claimed in claim 1, comprising two shafts each being rotatable about its own axis in the horizontal orifice of the corresponding one of said carriages and rigidly connected to the boom by its end projecting beyond the carriage.

3. An apparatus as claimed in claim 2, comprising two rotation drive means for said booms, each drive means being mounted on the corresponding one of said carriages and geared to the end of the corresponding one of said shafts, opposite that to which said boom is secured.

4. An apparatus as claimed in claim 1, wherein the shafts are connected to the boom ends by means of hinged joints.

5. An apparatus as claimed in claim 4, wherein each of the hinged joints is formed with a pivot mounted in an orifice of the corresponding one of said booms and rotatable about its own axis and rigidly secured to the corresponding one of said electrode holders by its end projecting beyond the boom.

6. An apparatus for electroslag remelting of ingots with alternate feeding of consumable electrodes into a melting space comprising:

at least one mould;

two vertical guides on both sides of the mould;

two carriages each being mounted on the corresponding one of said vertical guides and slidable along said vertical guide;

two shafts each being rotatable about its own axis in a horizontal orifice of the corresponding one of said carriages, one end of said shaft projecting beyond the corresponding carriage;

two booms, one end of each boom being rigidly connected to said projecting end of the corresponding one of said shafts;

two electrode holders each being connected by its other end to the corresponding one of said booms;

two hinged joints connecting said shafts to said boom ends, the axes of said shafts being located on the carriage;

rotation drive means for each said booms to move the axis of each said shaft through a circular arc while moving said carriages from a first position aligned with the mould axis of symmetry in which the mould axis of symmetry passes substantially along a tangent to both circular arcs to a second position away from said mould axis of symmetry, the circular arcs being paths described by the axes of said hinged joints; and, vertical drive means for each said carriages for sliding thereof along said vertical guides with the consumable electrodes being substantially aligned with the mould axis of symmetry when said rotation drive means aligns the said respective hinged joint with the mould axis of symmetry.

7. An apparatus as claimed in claim 2, wherein each of said carriages comprises a horizontal platform and a current-carrying plate mounted on said horizontal platform and offset with respect to said shaft in the direction of the mould in a manner to cause, when the corresponding one of said booms is rotated in a position in which the consumable electrode mounted in the corresponding one of said electrode holders is located substantially along the mould axis of symmetry, a portion of said electrode holder bear upon said current-carrying platform to form therewith a closed contact electrically connecting the corresponding one of said electrode holders with said power source.

8. An apparatus as claimed in claim 2, wherein each of said carriages comprises a supporting platform located underneath the corresponding one of said shafts on the side opposite said mould and adapted to support the corresponding one of said booms during the replacement of a consumable electrode in the corresponding one of said electrode holders.

9. An apparatus as claimed in claim 6, comprising two shaped recesses each being formed on one of said carriages on the side facing the corresponding one of said booms, whereas each of said electrode holders comprises a pin, the surface of said shaped recess ensuring, at the end of travel of the corresponding one of said booms in the direction of said mould, the contact with the corresponding one of said pins along a circular arc described about the axis of the corresponding one of said shafts.

10. An apparatus as claimed in claim 9, wherein there are provided levers each being rigidly connected to said pin, whereas each of said hinged joints is formed with a pivot rotatable about its own axis in orifice of the corresponding one of said booms and projecting beyond said boom, one of the projecting ends of said pivot being rigidly connected to the corresponding one of said electrode holders, and the other, to said lever.

* * * * *